US011759078B2

(12) United States Patent
Zhu et al.

(10) Patent No.: US 11,759,078 B2
(45) Date of Patent: Sep. 19, 2023

(54) DUST COLLECTION EQUIPMENT, METHOD AND APPARATUS FOR HANDLING AIR DUCT EXCEPTION OF DUST COLLECTION EQUIPMENT

(71) Applicant: HANGZHOU EZVIZ SOFTWARE CO., LTD., Zhejiang (CN)

(72) Inventors: Yunfei Zhu, Zhejiang (CN); Bin Guo, Zhejiang (CN); Zhenliang Hu, Zhejiang (CN); Anqiang Du, Zhejiang (CN)

(73) Assignee: Hangzhou Ezviz Software Co., Ltd., Zhejiang (CN)

( * ) Notice: Subject to any disclaimer, the term of this patent is extended or adjusted under 35 U.S.C. 154(b) by 641 days.

(21) Appl. No.: 16/643,121

(22) PCT Filed: Sep. 7, 2018

(86) PCT No.: PCT/CN2018/104567
§ 371 (c)(1),
(2) Date: Feb. 28, 2020

(87) PCT Pub. No.: WO2019/052404
PCT Pub. Date: Mar. 21, 2019

(65) Prior Publication Data

US 2020/0390309 A1 Dec. 17, 2020

(30) Foreign Application Priority Data

Sep. 13, 2017 (CN) ..... 201710823803.0

(51) Int. Cl.
*A47L 9/19* (2006.01)
*A47L 9/28* (2006.01)
(Continued)

(52) U.S. Cl.
CPC ..... *A47L 11/24* (2013.01); *A47L 9/19* (2013.01); *A47L 9/2821* (2013.01); *A47L 11/4094* (2013.01)

(58) Field of Classification Search
CPC ..... A47L 11/24; A47L 9/19; A47L 9/2821; A47L 11/4094; A47L 9/28; A47L 11/40; A47L 11/4011
See application file for complete search history.

(56) References Cited

U.S. PATENT DOCUMENTS

2006/0085095 A1* 4/2006 Reindie ..... A47L 9/2821 700/258
2014/0312813 A1* 10/2014 Murchie ..... H02P 6/34 318/400.03
(Continued)

FOREIGN PATENT DOCUMENTS

CN 201370542 Y 12/2009
CN 101877986 A 11/2010
(Continued)

OTHER PUBLICATIONS

Extended European search report of EP application No. 18855847.2 dated Jul. 23, 2020.
(Continued)

*Primary Examiner* — David Redding
(74) *Attorney, Agent, or Firm* — Knobbe, Martens, Olson & Bear, LLP

(57) ABSTRACT

Dust collection equipment, a method and apparatus for handling an air duct exception of the dust collection equipment are provided. The method includes: receiving an air pressure value detected by an air pressure sensor, wherein the air pressure sensor is located in an air path between a blower and a dust filtering apparatus of the dust collection equipment; determining whether an abnormal event occurs in an air duct of the dust collection equipment according to
(Continued)

the air pressure value detected in real time; and performing corresponding handling according to the type of the abnormal event, when it is determined that the abnormal event occurs.

16 Claims, 2 Drawing Sheets

(51) Int. Cl.
*A47L 11/24* (2006.01)
*A47L 11/40* (2006.01)

(56) References Cited

U.S. PATENT DOCUMENTS

| | | | |
|---|---|---|---|
| 2017/0000305 | A1 | 1/2017 | Gordon et al. |
| 2017/0001136 | A1 | 1/2017 | Hensel et al. |

FOREIGN PATENT DOCUMENTS

| | | | |
|---|---|---|---|
| CN | 105902241 | A | 8/2016 |
| CN | 106235974 | A | 12/2016 |
| CN | 106805841 | A | 6/2017 |
| CN | 206228293 | U | 6/2017 |
| DE | 102008010068 | A1 | 8/2009 |
| JP | H01-236028 | A | 9/1989 |
| JP | 01285235 | A | 11/1989 |
| JP | 2008100003 | A | 5/2008 |
| WO | WO2017004131 | A1 | 1/2017 |

OTHER PUBLICATIONS

Notification to grant patent for invention of Chinese application No. 201710823803.0 dated Jul. 21, 2020.
International search report of PCT application No. PCT/CN2018/104567 dated Nov. 7, 2018.
First office action of Chinese application No. 201710823803.0 dated Dec. 9, 2019.

* cited by examiner

DUST COLLECTION EQUIPMENT, METHOD AND APPARATUS FOR HANDLING AIR DUCT EXCEPTION OF DUST COLLECTION EQUIPMENT

CROSS-REFERENCE TO RELATED APPLICATION

This application is US national phase of a PCT international application No. PCT/CN2018/104567, filed on Sep. 7, 2018 and entitled "DUST COLLECTION DEVICE, AIR DUCT EXCEPTION HANDLING METHOD AND APPARATUS OF DUST COLLECTION DEVICE", which claims priority to Chinese Patent Application No. 201710823803.0, filed on Sep. 13, 2017 and entitled "DUST COLLECTION EQUIPMENT, METHOD AND APPARATUS FOR HANDLING AIR DUCT ABNORMALITY OF DUST COLLECTION EQUIPMENT", the entire contents of each of which are incorporated herein by reference.

TECHNICAL FIELD

The present disclosure relates the field of automatic control, and in particular to dust collection equipment, and a method and apparatus for handling an air duct abnormality of the duct collection equipment.

BACKGROUND

A cleaning robot, also known as a floor-sweeping robot, an automatic sweeper, a smart dust collector, a robot dust collector or the like, is one type of smart household appliances and may automatically finish the floor cleaning work in a room by virtue of certain artificial intelligence. Generally, a blower is used to collect garbage such as ground dust through an air duct into its own dust collecting device to complete the ground cleaning.

When there is too much dust or large foreign matter is sucked in, the air duct of the cleaning robot may be blocked.

At present, cleaning robots on the market generally implement air duct blockage detection by monitoring the power and rotating speed of the blower. However, the detection of this mode is not accurate and usually the air duct blockage can be detected after the air duct is completely blocked. Another approach to detect the air duct blockage is to detect whether a dust collecting device is full by a photoelectric sensor. However, this approach requires frequent manual cleaning because the photoelectric sensor is easily polluted and covered by dust in the dust collecting device.

SUMMARY

In view of this, an embodiment of the present disclosure provides dust collection equipment, and a method and apparatus for handling air duct abnormality of the duct collection equipment, which may punctually find an abnormal situation of an air duct of the dust collection equipment and thus prevent the air duct from being blocked. The technical solutions thereof are as follows.

In an aspect, there is provided a method for handling an air duct abnormality of dust collection equipment, including:

receiving an air pressure value detected by an air pressure sensor, wherein the air pressure sensor is located in an air path between a blower and a dust filtering apparatus of the dust collection equipment;

determining whether an abnormal event occurs in an air duct of the dust collection equipment, according to the air pressure value detected in real time; and performing corresponding handling according to the type of the abnormal event, when it is determined that the abnormal event occurs.

Optionally, determining whether the abnormal event occurs in the air duct of the dust collection equipment according to the air pressure value detected in real time includes:

determining that an abnormal event occurs and the abnormal event is that the air duct is blocked, when the air pressure value detected in real time drops to be equal to or less than a set blockage air pressure threshold from normal operating air pressure within a first duration;

determining that an abnormal event occurs and the abnormal event is that collected dust is excessive, when the air pressure value detected in real time gradually drops to be equal to or less than a set dumping air pressure threshold and continuously and gradually drops within a second duration; and determining that an abnormal event occurs and the abnormal event is that the dust filtering apparatus is excessively dirty, when the air pressure value detected in real time drops to be equal to or less than a set excessively dirty air pressure threshold and keeps stable within a third duration.

Optionally, the performing corresponding handling according to the type of the abnormal event when it is determined that the abnormal event occurs includes:

when the abnormal event is that the air duct is blocked, closing the blower and restarting the blower after a fourth duration; or controlling the power of the blower to be increased; and/or when the abnormal event is that the air duct is blocked, closing the blower and restarting the blower after a fifth duration, and controlling the power of the blower to be increased when the detected air pressure value does not restore to the normal operating air pressure.

Optionally, the performing corresponding handling according to the type of the abnormal event when it is determined that the abnormal event occurs includes:

outputting prompt information that it needs a user to manually handle the blockage after the corresponding handling is completed for the abnormal event of the air duct blockage and when the detected air pressure value does not restore to the normal operating air pressure.

Optionally, the performing corresponding handling according to the type of the abnormal event when it is determined that the abnormal event occurs includes:

executing the handling of dumping dust or outputting prompt information of dumping dust, when the abnormal event is that collected dust is excessive.

Optionally, the performing corresponding processing according to the type of the abnormal event when it is determined that there is the abnormal event includes:

executing the handling of cleaning the dust filtering apparatus or outputting prompt information of cleaning the dust filtering apparatus, when the abnormal event is that the dust filtering apparatus is excessively dirty.

In another aspect, there is provided an apparatus for handling an air duct abnormality of dust collection equipment, including:

an air pressure sensor which is located in an air path between a blower and a dust filtering apparatus of the dust collection equipment and configured to detect an air pressure value in the air path in real time;

a processor configured to receive the air pressure value in the air path, which is detected by the air pressure sensor in real time, determine whether an abnormal event occurs and generate a corresponding execution instruction according to the type of the abnormal event when it is determined that the abnormal event occurs; and an execution unit configured to receive the execution instruction from the processor and perform corresponding handling according to the execution instruction.

Optionally, the processor is specifically configured to:

determine that an abnormal event occurs and the abnormal event is that the air duct is blocked, when the air pressure value detected in real time drops to be equal to or less than a set blockage air pressure threshold from normal operating air pressure within a first duration;

determine that an abnormal event occurs and the abnormal event is that collected dust is excessive, when the air pressure value detected in real time drops to be equal to or less than a set dumping air pressure threshold and drops gradually within a second duration; and determine that the abnormal event occurs and the abnormal event is that the dust filtering apparatus is excessively dirty, when the air pressure value detected in real time drops to be equal to or less than a set excessively dirty air pressure threshold and keeps stable within a third duration.

Optionally, the execution unit is specifically configured to:

when the abnormal event is that the air duct is blocked, close the blower and restart the blower after a fourth duration; or control the power of the blower to be increased; and/or close the blower and restart the blower after a fifth duration, and control power of the blower to be increased when the detected air pressure value does not restore to the normal operating air pressure.

Optionally, the execution unit includes a prompt module and the execution unit is further configured to:

output, by the prompt module, a prompt that it needs a user to manually handle the blockage, after the corresponding handling is completed for the abnormal event that the air duct is blocked and the detected air pressure value does not restore to the normal operating air pressure.

Optionally, the execution unit includes a prompt module and the execution unit is further specifically configured to:

execute the handling of dumping dust or output, by the prompt module, a prompt that it needs the user to dump dust, when the abnormal event is that collected dust is excessive.

Optionally, the execution unit includes a prompt module and the execution unit is further specifically configured to:

execute the handling of cleaning the dust filtering apparatus or output, by the prompt module, a prompt that it needs a user to clean the dust filtering apparatus, when the abnormal event is that the dust filtering apparatus is excessively dirty.

In yet another aspect, there is provided dust collection equipment, including a dust collecting device, a blower, a control unit, a dust filtering apparatus and an air pressure sensor, wherein The dust collecting device is provided with a dust suction opening for sucking dust;

the dust filtering apparatus is located between the blower and the dust collecting device;

the air pressure sensor is located in an air path between the dust filtering apparatus and the blower; and the control unit includes: a non-volatile storage medium and a processor, wherein the non-volatile storage medium stores a program, and the processor implements the method in the above aspect by executing the program.

Optionally, the dust collection equipment is a cleaning robot.

BRIEF DESCRIPTION OF THE DRAWINGS

In order to describe the technical solutions in the embodiments of the present more clearly, the following briefly introduces the accompanying drawings required for describing the embodiments. Apparently, the accompanying drawings in the following description show merely some embodiments of the present disclosure, and a person of ordinary skill in the art may also derive other drawings from these accompanying drawings without creative efforts.

DETAILED DESCRIPTION

The present disclosure will be described in further detail with reference to the accompanying drawings, to present the objects, technical solutions, and advantages of the present disclosure more clearly.

Figure 1:
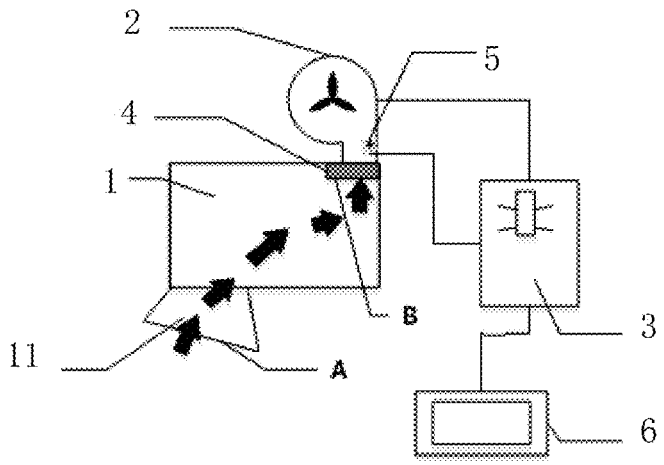
FIG. 1 is a schematic diagram of an exemplary dust collection equipment according to an embodiment of the present disclosure.

FIG. 1 is a schematic diagram of an exemplary dust collection equipment provided in an embodiment of the present disclosure. With reference to FIG. 1, the dust collection equipment includes a dust collecting device 1, a blower 2, a control unit 3, a dust filtering apparatus 4 and an air pressure sensor 5.

The dust collecting device 1 is provided with a dust suction opening 11 for sucking dust and the dust is sucked into the dust collecting device 1 from the dust suction opening 11. The dust collecting device 1 is connected to the blower 2 through an outlet. In order to prevent the dust from entering the blower 2, the dust filtering apparatus 4 is provided between the blower 2 and the dust collecting device 1. Exemplarily, the dust filtering apparatus 4 is located at the outlet of the dust collection equipment 1. The air pressure sensor 5 is located in an air path between the dust filtering apparatus 4 and the blower 2, used for collecting an air pressure value in the air path, and prevented from being affected by the dust in the dust collecting device 1.

It may be understood that an air duct mentioned in the embodiment of the present disclosure not only includes an internal chamber of the dust collecting device 1, but also includes a path through which airflow flows from the outlet of dust collecting device 1 to the blower 2. This path at least includes the air path between the dust filtering apparatus 4 and the blower 2.

The air pressure sensor 5 may be located at an inlet, which is connected to the outlet of the dust collecting device 1, of the blower 2. For example, the air pressure sensor 5 is directly mounted on a side wall of the inlet of the blower 2 or is mounted on the side wall of the inlet of the blower 2 through an attachment.

Considering making the air pressure value detected by the air pressure sensor 5 more accurate, a good airtightness may be kept between various connected components of the dust collection equipment. As such, there is no loss of a suction force from the dust suction opening 11 to the dust filtering apparatus 4. It may be considered that the air pressure value detected by the air pressure sensor 5 is substantially in positive correlation with an air velocity of the dust suction opening 11. According to whether the positive correlation is abnormal, it may be accurately determined whether an abnormal event occurs in the air duct of the dust collection equipment.

The above good airtightness may be achieved by arranging a sealing element such as an elastic sealing ring, an elastic washer or the like between the two components connected to each other. It may be understood that the above components include the dust collecting device 1, the blower 2, the dust filtering apparatus 4 and the air pressure sensor 5.

The control unit 3 is in signal communication with the air pressure sensor 5, receives the air pressure value collected by the air pressure sensor 5, analyses this air pressure value and determines the state of the air duct. Further, the control unit 3 may further be in signal communication with the blower 2. The control unit 3 may control the blower 2 according to the determined state of the air duct. For example, when it is determined that the state of the air duct is air duct is blocked, the control unit 3 controls the blower 2 to be closed.

The dust collection equipment provided in the embodiment of the present disclosure may further include: a prompt apparatus 6. This prompt apparatus 6 for example is a display apparatus (such as a display screen, a flasher or the like) and/or a sound production apparatus (such as a voice prompt apparatus, a buzzer or the like). The control unit 3 is in signal communication with the prompt apparatus 6, and is used for sending a prompt to a user for requesting a manual intervention handling by the prompt apparatus 6, when it is determined that the air duct is abnormal or the problem of abnormality cannot be solved by controlling the blower.

The prompt apparatus 6 may be an operating component independent of the control unit 3, and may also be a prompt module dependent on the control unit 3.

The control unit 3 includes a non-volatile storage medium and a processor. The non-volatile storage medium stores a program, and the processor implements a method for handling an air duct abnormality of the dust collection equipment described in the following embodiment by executing the program and controlling all respective components. The control unit 3 further includes an execution unit configured to receive an execution instruction from the processor and perform corresponding handling according to the execution instruction. When being the prompt module dependent on the control unit 3, the prompt apparatus 6 may be specifically dependent on the execution unit.

Figure 2:
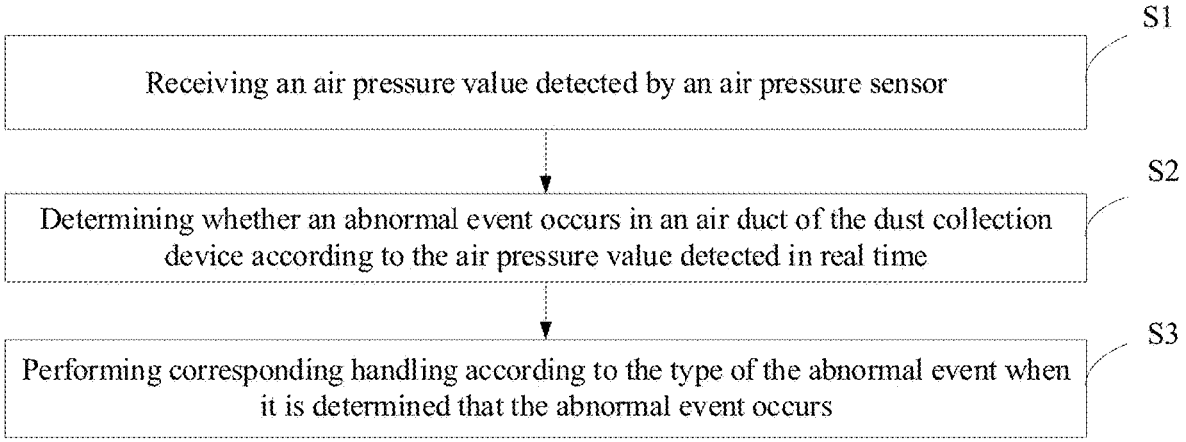
FIG. 2 is a flow chart showing procedures of a method for handling an air duct abnormality of dust collection equipment according to another embodiment of the present disclosure.

FIG. 2 is a flow chart showing procedures of a method for handling an air duct abnormality of dust collection equipment provided in another embodiment of the present disclosure. As shown in FIG. 2, the method includes the following steps.

In step S1, an air pressure value detected by an air pressure sensor is received.

As described in the above embodiment, the air pressure sensor is arranged in the air path between the blower and the dust filtering apparatus of the dust collection equipment, so that the air pressure sensor is not affected by dust in the dust collecting device, and the measured air pressure value is more accurate.

In step S2, whether an abnormal event occurs in an air duct of the dust collection equipment is determined according to the air pressure value detected in real time.

When no abnormal event occurs in the air duct and the dust collection equipment operates normally, the detected air pressure value is relatively stable and within the range of normal operating air pressure. When the abnormal event occurs in the air duct, the air pressure changes, and thus it may be determined whether the abnormal event occurs in the air duct according to the air pressure value detected in real time.

In the embodiment of the present disclosure, the determination may be made according to an air pressure value originally detected. But in this embodiment of the present disclosure, the following method is adopted: arithmetic mean low-pass filtering is performed on air pressure values detected continuously to obtain an air pressure change curve and an air pressure value at corresponding time is acquired on the air pressure change curve for the determination. This determination method is more accurate and avoids determination errors caused by that certain data are abnormal.

For example, the following three abnormal events may be determined: an abnormal event that the air duct is blocked, an abnormal event that collected dust is excessive, and an abnormal event that the dust filtering apparatus is excessively dirty, which are respectively described below.

For the abnormal event that the air duct is blocked:

when the air pressure value detected in real time drops to be equal to or less than a set blockage air pressure threshold from normal operating air pressure within a first duration, it may be determined that the abnormal event occurs and the abnormal event is that the air duct is blocked. This is because in an ordinary circumstance, the air pressure value suddenly drops to be equal to or less than the blockage air pressure threshold within a short time, it is obvious this is caused by that the air duct is blocked.

The normal operating air pressure is the air pressure when the dust collection equipment is operated normally. Generally, one air pressure value range may be set, and as long as the detected air pressure value is within the air pressure value range, it may be considered that the air pressure is the normal operating air pressure. One normal air pressure change rate threshold may also be set, and only if the air pressure is within the air pressure value range and an air pressure change rate is less than the normal air pressure change rate threshold, the air pressure is considered to be the normal operating air pressure.

The blockage air pressure threshold may be set according to the maximum air pressure value detected when the air duct of the dust collection equipment is blocked under various cases. For example, the blockage air pressure threshold is set to be the maximum air pressure value or a value therearound.

The first duration may also be determined according to the maximum duration which is detected when the air pressure value drops to be equal to or less than the blockage air pressure threshold, and the air duct of the dust collection equipment is blocked under various cases. For example, the first duration is set to be the maximum duration value or a value therearound.

It should be understood that after the detected air pressure value drops to be equal to or less than a preset blockage air pressure threshold from the normal operating air pressure within the first duration, it may wait for a time period and when the detected air pressure value is still less than the blockage air pressure threshold, it is determined that the abnormal event that the air duct is blocked occurs. This is because sometimes the abnormal event that the air duct is blocked may be eliminated by the operation of the dust collection equipment itself. For example, foreign matters blocking the dust inlet are swallowed into the dust collecting device, and the air pressure value is above the blockage air pressure threshold at this time but it is not considered that the abnormal event that the air duct is blocked still exists.

Figure 3:
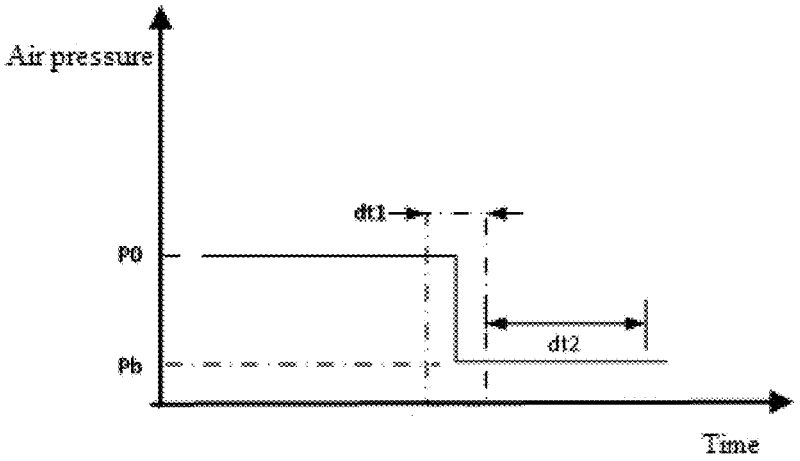
FIG. 3 shows an exemplary air pressure curve for determining an abnormal event that an air duct is blocked occurs.

FIG. 3 shows an exemplary air pressure curve for determining an abnormal event that an air duct is blocked occurs. As shown in FIG. 3, an initial air pressure value is normal operating air pressure P0 and keeps stable, and then the air pressure value drops to air pressure Pb less than the blockage air pressure threshold within a duration dt1 and remains unchanged within a duration dt2. It can thus be determined that the abnormal event that the air duct is blocked occurs.

For the abnormal event that collected dust is excessive:

when the air pressure value detected in real time gradually drops to be equal to or less than a set dumping air pressure threshold and gradually drops within a second duration, it is determined that an abnormal event occurs and the abnormal event is that collected dust is excessive.

When the dust collected in the dust collecting device is excessive, airflow circulation in the air duct is affected since most of internal chamber of the dust collection equipment is occupied by the dust. Thus, the detected air pressure value drops and the corresponding handling that needs to be performed at this time is to dump the dust collected in the dust collecting device. The dumping air pressure threshold may be set according to the air pressure values which are measured multiple times when the dust in the dust collecting device reaches an excessive threshold.

According to actual needs, a time period before reaching the set dumping air pressure threshold may be selected as the second duration, a time period after reaching the set dumping air pressure threshold may also be selected as the second duration, or a time period spanning before and after the moments when the set dumping air pressure threshold is reached is selected as the second duration.

Whether a gradual drop is satisfied may be defined by amplitudes or absolute values of decreases in the air pressure value within the second duration. These decrease amplitudes or absolute values may also be set after multiple experiments.

Figure 4:
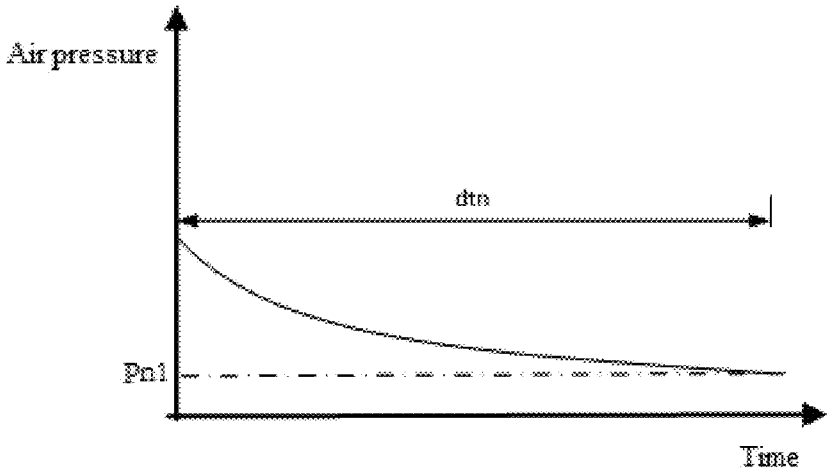
FIG. 4 shows an exemplary air pressure curve for determining an abnormal event that collected dust is excessive occurs.

FIG. 4 shows an exemplary air pressure curve for determining an abnormal event that collected dust is excessive occurs. As shown in FIG. 4, within a duration dtn, the detected air pressure value drops gradually until reaching a dumping air pressure threshold Pn1. It can thus be determined that the abnormal event that collected dust is excessive occurs.

For the abnormal event that the dust filtering apparatus is excessively dirty:

when the air pressure value detected in real time drops to be equal to or less than a set too much dirty air pressure threshold and keeps stable within a third duration, it is determined that an abnormal event occurs and the abnormal event is that the dust filtering apparatus is too dirty.

When the dust filtering apparatus is excessively dirty, airflow circulation in the air duct is affected since at least part of meshes of the dust filtering apparatus is blocked by the dust and thus the detected air pressure value drops. Because the situation that the meshes are blocked by the dust is not remarkably worsened within a short time, the air pressure value keeps stable within a certain time. The too much dirty air pressure threshold may be set according to air pressure values measured multiple times when the dust filtering apparatus is excessively dirty under various cases.

The third duration may be set according to needs and actual situations.

Whether the air pressure value keeps stable is satisfied may be defined by amplitudes or absolute values of changes in the air pressure value within the third duration. These change amplitudes or absolute values may also be set after multiple experiments.

Figure 5:
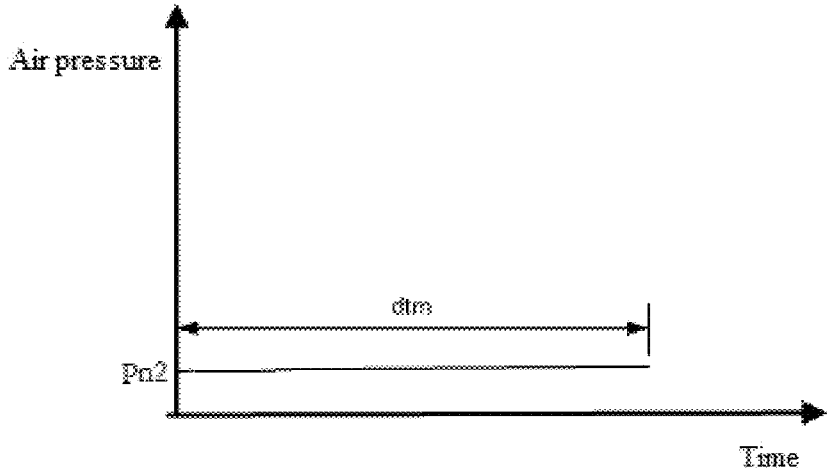
FIG. 5 shows an exemplary air pressure curve for determining an abnormal event that a dust filtering apparatus is excessively dirty occurs.

FIG. 5 shows an exemplary air pressure curve for determining an abnormal event that a dust filtering apparatus is excessively dirty occurs. As shown in FIG. 5, within a duration dtm, the detected air pressure value keeps stable and is equal to an excessively dirty air pressure threshold Pn2. It can thus be determined that the abnormal event that the dust filtering apparatus is excessively dirty occurs.

It may be understood by a person skilled in the art that the three abnormal events listed above are only examples. There may be other abnormal events in actual operation. These abnormal events all fall within the scope of the present disclosure as long as they may be determined according to the detected air pressure values.

In step S3, when it is determined that the abnormal event occurs, corresponding handling is performed according to the type of the abnormal event.

After the abnormal event occurs and its type is recognized, the corresponding handling may be performed according to the type of the abnormal event. A program for performing the handling may be preset in a non-volatile memory of the control unit of the dust collection equipment. The following illustrates how to perform handling according to the type of the abnormal event by taking the three abnormal events described above as examples. It should be understood by a person skilled in the art that for other possible types of abnormal events, as long as they are determined according to the detected air pressure values, the corresponding handling performed thereon also falls within the scope of the present disclosure.

When the abnormal event is that the air duct is blocked, the blower may be closed and the blower is opened again after a fourth duration. This handling mode can cause the foreign matters blocking the dust suction opening to be dropped. Or the power of the blower may be controlled to be increased and this handling mode can cause the foreign matters to be sucked into the dust collecting device. The above two handling modes may prevent the foreign mattes from blocking the dust suction opening, thereby eliminating the abnormal event that the air duct is blocked. The fourth duration may be set according to results of multiple experiments, and the increase degree or magnitude of the power of the blower may also be set according to experimental results.

The above two handling modes may be used separately, and may also be used in a combined manner to achieve a better effect. For example, the blower is closed firstly, the blower is restarted after the fourth duration, and then the power of the blower is controlled to be increased when the detected air pressure value does not restore to the normal operating air pressure which indicates that the foreign matters still block the dust suction opening and at this time. The foregoing sequence may not be reversed generally. This is because that if the foreign matters block the surface of the dust suction opening, the foreign matters will drop by closing the blower and they will no longer block the dust suction opening. However, the blockage caused by the foreign matters would be more serious if the suction force were directly increased.

After the corresponding handling (for example, the blower is closed temporarily and/or the power is increased) is performed for the abnormal event that the air duct is blocked, when the detected air pressure value does not restore to the normal operating air pressure, it indicates that the foreign matters still block the dust suction opening and a prompt that it needs a user to manually handle the blockage may also be output. In the embodiment of the present disclosure, this prompt may be implemented through the above prompt apparatus, such as a display apparatus (a display screen) and/or a sound production apparatus (a sound generator).

When the abnormal event is that collected dust is excessive, if the dust collection equipment has an automatic dust-dumping function, the handling of dumping dust is executed; and if the dust collection equipment does not have the automatic dust-dumping function, a prompt that it needs the user to dump dust is output and the handling is performed by the user.

When the abnormal event is that the dust filtering apparatus is excessively dirty, if the dust collection equipment has a function of automatically cleaning the dust filtering apparatus, the handling of cleaning the dust filtering apparatus is performed; and if the dust collection equipment does not have the function of automatically cleaning the dust filtering apparatus, a prompt that it needs the user to clean the dust filtering apparatus is output and the handling is performed by the user.

According to the method for handling an air duct abnormality provided in the embodiment, the air pressure value is acquired by the air pressure sensor located in the air path between the blower and the dust filtering apparatus of the dust collection equipment; it is determined whether the abnormal event occurs in the air duct according to the air pressure value detected in real time; and the corresponding handling is performed according to the type of the abnormal event. The abnormality detection which is performed on the basis of the air pressure of the air duct is simple and practicable; the handling for eliminating the abnormal event may also be performed by presetting a corresponding manner, and both the degree of automation and the handling efficiency are relatively high; and the situation that the dust collection equipment cannot be operated normally or even is damaged due to full blockage of the air duct of the dust collection equipment may be effectively prevented. Particularly, when the dust collection equipment is the cleaning robot, the intelligent level of the cleaning robot may be improved.

Figure 6:
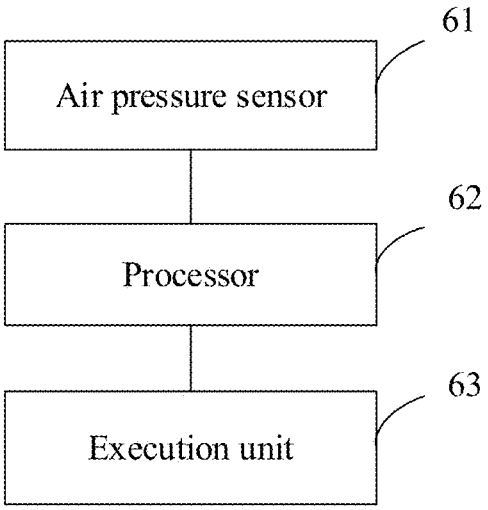
FIG. 6 is a block diagram of an apparatus for handling an air duct abnormality of dust collection equipment according to still another embodiment of the present disclosure.

FIG. 6 is a block diagram of an apparatus for handling an air duct abnormality of dust collection equipment according to still another embodiment of the present disclosure. As shown in FIG. 6, the apparatus includes an air pressure sensor 61, a processor 62 and an execution unit 63.

The air pressure sensor 61 is located in an air path between a blower and a dust filtering apparatus of the dust collection equipment and configured to detect an air pressure value in the air path in real time.

The processor 62 is configured to receive the air pressure value in the air path, which is detected by the air pressure sensor in real time, determine whether an abnormal event occurs, and generate an execution instruction according to the type of the abnormal event and output the execution instruction to an execution unit 63 when it is determined that the abnormal event occurs.

The execution unit 63 is configured to receive the execution instruction from the processor 62 and perform corresponding handling according to the execution instruction.

The processor 62 may be specifically configured to:

determine that an abnormal event occurs and the abnormal event is that the air duct is blocked, when the air pressure value detected in real time drops to be equal to or less than a preset blockage air pressure threshold from normal operating air pressure within a first duration;

determine that an abnormal event occurs and the abnormal event is that collected dust is excessive, when the air pressure value detected in real time drops to be equal to or less than a preset dumping air pressure threshold and gradually drops within a second duration; and determine that the abnormal event occurs and the abnormal event is that the dust filtering apparatus is excessively dirty, when the air pressure value detected in real time drops to be equal to or less than a preset excessively dirty air pressure threshold and keeps stable within a third duration.

The execution unit 63 may be specifically configured to: when the abnormal event is that the air duct is blocked, close the blower and restart the blower after a fourth duration; or control the power of the blower to be increased; and/or close the blower, restart the blower after a fifth duration and control the power of the blower to be increased when it is detected that the air pressure value does not restore to the normal operating air pressure.

The execution unit 63 may also include a prompt module, which may be for example a sound generator or a display device. The execution unit 63 may also be specifically configured to execute at least one of:

after the corresponding handling is performed for the abnormal event that the air duct is blocked and when the detected air pressure value does not restore to the normal operating air pressure, outputting, by a prompt module, a prompt that it needs a user to manually handle the blockage;

when the abnormal event that collected dust is excessive occurs, performing the handling of dumping dust or outputting, by the prompt module, a prompt that it needs the user to dump dust; and when the abnormal event that the dust filtering apparatus is excessively dirty occurs, performing the handling of cleaning the dust filtering apparatus or outputting, by the prompt module, a prompt that it needs the user to clean the dust filtering apparatus.

As an optional mode, the processor 62 may perform arithmetic mean low-pass filtering on air pressure values detected continuously to obtain an air pressure change curve and thus air pressure values at corresponding time are acquired on the air pressure change curve for the determination.

Since the embodiment of the apparatus for handling an air duct abnormality of the dust collection equipment is a virtual device embodiment corresponding to the embodiment of the method for handling an air duct abnormality of the dust collection equipment, the description for the embodiment of the method for handling an air duct abnormality of the dust collection equipment is likewise suitable for the embodiment of the apparatus for handling an air duct abnormality of the dust collection equipment. Thus, some specific implementation details and effects are not repeatedly described in the embodiment of the apparatus for handling an air duct abnormality of the dust collection equipment and may make reference to the description for the embodiment of the method for handling an air duct abnormality of the dust collection equipment.

In the embodiment of the present disclosure, the air pressure value is acquired by the air pressure sensor arranged in the air path between the blower and the dust filtering apparatus of the dust collection equipment; it is determined whether the abnormal event occurs in the air duct of the dust collection equipment according to the air pressure value detected in real time; and the corresponding handling is performed according to the type of the abnormal event. This abnormality detection mode based on the air pressure of the air duct is simple and practicable; the handling is performed by presetting a corresponding manner, and both the degree of automation and the handling efficiency are relatively higher; and the situation that the dust collection equipment cannot be operated normally or even is damaged due to full blockage of the air duct of the dust collection equipment may be effectively prevented. Particularly, when the dust collection equipment is the cleaning robot, the intelligent level of the cleaning robot may be improved.

It may be understood by a person of an ordinary skill in the art that all or part of steps and modules in the above embodiments may be completed by hardware and may also be completed by a program instructing relevant hardware. The program may be stored in a computer-readable storage medium and the storage medium mentioned above may be a read-only memory, a magnetic disk, an optical disc or the like.

The above description is only intended to facilitate the understanding of the technical solution of the present disclosure by a person skilled in the art, and is not intended to limit the present disclosure. Any modifications, equivalent replacements, improvements and the like made within the spirit and principles of the present disclosure should be included within the scope of protection of the present disclosure.

The invention claimed is:

1. A method for handling an air duct abnormality of dust collection equipment, comprising:

receiving an air pressure value detected by an air pressure sensor, wherein the air pressure sensor is located in an air path between a blower and a dust filter of the dust collection equipment;

determining whether an abnormal event occurs in an air duct of the dust collection equipment according to the air pressure value detected in real time; and performing corresponding handling according to the type of the abnormal event, in response to determining that the abnormal event occurs, and wherein determining whether the abnormal event occurs the air duct of the dust collection equipment according to the air pressure value detected in real time further comprises:

determining that an abnormal event in which the air duct is blocked occurs, in response to determining that the air pressure value detected in real time drops to be equal to or less than a set blockage air pressure threshold from normal operating air pressure within a first duration;

determining that an abnormal event in which collected dust is excessive occurs, in response to determining that the air pressure value detected in real time gradually drops to be equal to or less than a set dumping air pressure threshold, and continuously and gradually drops within a second duration; and determining that an abnormal event in which the dust filter is excessively dirty occurs, in response to determining that the air pressure value detected in real time drops to be equal to or less than a set excessively dirty air pressure threshold, and keeps stable within a third duration.

2. The method according to claim 1, wherein performing the corresponding handling according to the type of the abnormal event in response to determining that the abnormal event occurs comprises at least one of:

in response to determining occurrence of the abnormal event in which the air duct is blocked, closing the blower and restarting the blower after a fourth duration or controlling power of the blower to be increased, or closing the blower, restarting the blower after a fifth duration and controlling the power of the blower to be increased in response to determining that the detected air pressure value does not restore to the normal operating air pressure.

3. The method according to claim 2, wherein performing the corresponding handling according to the type of the abnormal event in response to determining that the abnormal event occurs further comprises:

outputting prompt information that it needs a user to manually handle the blockage, in response to determining that the detected air pressure value does not restore to the normal operating air pressure after the corresponding handling is completed for the abnormal event in which the air duct is blocked.

4. The method according to claim 1, wherein performing the corresponding handling according to the type of the abnormal event in response to determining that the abnormal event occurs comprises:

executing the handling of dumping dust or outputting prompt information of dumping dust, in response to determining occurrence of the abnormal event in which the collected dust is excessive.

5. The method according to claim 1, wherein performing the corresponding handling according to the type of the abnormal event in response to determining that the abnormal event occurs comprises:

executing the handling of cleaning the dust filter or outputting prompt information of cleaning the dust filter, in response to determining occurrence of the abnormal event in which the dust filter is excessively dirty.

6. An apparatus for handling an air duct abnormality of dust collection equipment, comprising:

an air pressure sensor which is located in an air path between a blower and a dust filter of the dust collection equipment and configured to detect an air pressure value in the air path in real time; and a processor configured to receive the air pressure value in the air path, which is detected by the air pressure sensor in real time, determine whether an abnormal event occurs, generate a corresponding execution instruction according to the type of the abnormal event in response to a determination that the abnormal event occurs, the processor further configured to perform corresponding handling according to the execution instruction, and wherein the processor is further configured to:

determine that an abnormal event in which the air duct is blocked occurs, when the air pressure value detected in real time drops to be equal to or less than a set blockage air pressure threshold from normal operating air pressure within a first duration;

determine that an abnormal event in which collected dust is excessive occurs, when the air pressure value detected in real time drops to be equal to or less than a set dumping air pressure threshold, and drops gradually within a second duration; and determine that an abnormal event in which the dust filter is excessively dirty occurs, when the air pressure value detected in real time drops to be equal to or less than a set excessively dirty air pressure threshold, and keeps stable within a third duration.

7. The apparatus according to claim 6, wherein the processor is configured to perform at least one of:

when the abnormal event in which the air duct is blocked occurs, closing the blower and restarting the blower after a fourth duration or control power of the blower to be increased, or closing the blower, restarting the blower after a fifth duration and controlling the power of the blower to be increased when the detected air pressure value does not restore to the normal operating air pressure.

8. The apparatus according to claim 7, wherein the processor is further configured to:

output a prompt that it needs a user to manually handle the blockage, when the detected air pressure value does not restore to the normal operating air pressure after the corresponding handling is completed for the abnormal event in which the air duct is blocked.

9. The apparatus according to claim 6, wherein the processor is further configured to:

execute the handling of dumping dust or output a prompt that it needs a user to dump dust, when the abnormal event in which the collected dust is excessive occurs.

10. The apparatus according to claim 6, wherein the processor is further configured to:

execute the handling of cleaning the dust filter or output a prompt that it needs a user to clean the dust filter, when the abnormal event in which the dust filter is excessively dirty occurs.

11. Dust collection equipment, comprising: a dust collector, a blower, a controller, a dust filter and an air pressure sensor, wherein:

the dust collector is provided with a dust suction opening for sucking dust;

the dust filter is located between the blower and the dust collector;

the air pressure sensor is located in an air path between the dust filter and the blower; and the controller comprises a non-volatile storage medium and a processor, wherein the non-volatile storage medium stores a program, and the processor implements the method according to claim 1 by executing the program.

12. The dust collection equipment according to claim 11, wherein the dust collection equipment is a cleaning robot.

13. Dust collection equipment, comprising: a dust collector, a blower, a controller, a dust filter and an air pressure sensor, wherein:

the dust collector is provided with a dust suction opening for sucking dust;

the dust filter is located between the blower and the dust collector;

the air pressure sensor is located in an air path between the dust filter and the blower; and the controller comprises a non-volatile storage medium and a processor, wherein the non-volatile storage medium stores a program, and the processor implements the method according to claim 3 by executing the program.

14. Dust collection equipment, comprising: a dust collector, a blower, a controller, a dust filter and an air pressure sensor, wherein:

the dust collector is provided with a dust suction opening for sucking dust;

the dust filter is located between the blower and the dust collector;

the air pressure sensor is located in an air path between the dust filter and the blower; and the controller comprises a non-volatile storage medium and a processor, wherein the non-volatile storage medium stores a program, and the processor implements the method according to claim 4 by executing the program.

15. Dust collection equipment, comprising: a dust collector, a blower, a controller, a dust filter and an air pressure sensor, wherein:

the dust collector is provided with a dust suction opening for sucking dust;

the dust filter is located between the blower and a dust collector;

the air pressure sensor is located in an air path between the dust filter and the blower; and the controller comprises a non-volatile storage medium and a processor, wherein the non-volatile storage medium stores a program, and the processor implements the method according to claim 5 by executing the program.

16. Dust collection equipment, comprising: a dust collector, a blower, a controller, a dust filter and an air pressure sensor, wherein:

the dust collector is provided with a dust suction opening for sucking dust;

the dust filter is located between the blower and the dust collector;

the air pressure sensor is located in an air path between the dust filter and the blower; and the controller comprises a non-volatile storage medium and a processor, wherein the non-volatile storage medium stores a program, and the processor implements the method according to claim 5 by executing the program.

* * * * *